US008109624B2

(12) United States Patent
Horade

(10) Patent No.: US 8,109,624 B2
(45) Date of Patent: Feb. 7, 2012

(54) IMAGE FORMING APPARATUS

(75) Inventor: Kenta Horade, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 693 days.

(21) Appl. No.: 12/053,578

(22) Filed: Mar. 22, 2008

(65) Prior Publication Data

US 2008/0240749 A1 Oct. 2, 2008

(30) Foreign Application Priority Data

Mar. 30, 2007 (JP) ..... 2007-091913

(51) Int. Cl.
*B41J 29/38* (2006.01)
*B41J 2/01* (2006.01)

(52) U.S. Cl. ..... 347/102; 347/14

(58) Field of Classification Search ..... 347/6–7, 347/14, 101–102, 19
See application file for complete search history.

(56) References Cited

U.S. PATENT DOCUMENTS 5,109,234 A * 4/1992 Otis et al. ..... 347/14
2005/0275672 A1 12/2005 Koshikawa

FOREIGN PATENT DOCUMENTS

JP 2001-334644 A 12/2001
JP 2003-320727 A 11/2003
JP 2004-262171 A 9/2004
JP 2004262171 A * 9/2004
JP 2005-349710 A 12/2005
JP 2005349710 A * 12/2005
JP 2006-212869 A 8/2006
JP 2006212869 A * 8/2006

OTHER PUBLICATIONS

Japanese Patent Office, Notice of Reason(s) for Rejection, for Patent Application No. 2007-091913, mailed Feb. 10, 2009. (Counterpart to above-captioned U.S. patent application.)
Japan Patent Office; Decision of Rejection in Japanese Patent Application No. 2007-090913 (counterpart to the above-captioned U.S. patent application) mailed Oct. 6, 2009 (partial translation).

* cited by examiner

*Primary Examiner* — Jason Uhlenhake
(74) *Attorney, Agent, or Firm* — Baker Botts L.L.P.

(57) ABSTRACT

An image forming apparatus includes a calculating device, a waiting time calculating device, and a print controlling device. The calculating device divides print data to be printed onto a recording medium into a plurality of zones along a conveyance direction of the recording medium. The calculating device calculates printing time and drying time per each divided zone based on a data amount in each zone. The waiting time calculating device calculates waiting time from completion of printing onto the recording medium until the recording medium has been dried, based on the printing time and the drying time per each zone in consideration of elapse of the drying time of the previously printed zone(s) during printing. The print controlling device configures settings for printing of the recording medium based on the waiting time and performs printing according to the settings.

11 Claims, 11 Drawing Sheets

IMAGE FORMING APPARATUS

CROSS-REFERENCE TO RELATED APPLICATIONS

This application claims the benefit of Japanese Patent Application No. 2007-091913 filed Mar. 30, 2007 in the Japan Patent Office, the disclosure of which is incorporated herein by reference.

BACKGROUND

This invention relates to an image forming apparatus that prints an image onto a recording medium.

In a conventional image forming apparatus, the following comparison is performed in order to control stains, such as a rubbing stain and a transfer stain, on a recording medium at duplex printing. That is, since these stains are caused by a sheet feed roller pressed against the recording medium, an amount of print data to be printed on a contact zone of the front face of the recording medium against which the sheet feed roller is pressed is compared with an amount of print data to be printed on a contact zone of the back face against which the sheet feed roller is pressed. Printing is firstly started to the face having less print data.

SUMMARY

However, even if such comparison is performed with respect to the print data to be printed in the contact zones in the conventional apparatus, it takes time to dry a portion where there is a large amount of print data other than the contact zones. If the recording medium is reversed to perform printing on the other side of the recording medium before drying the portion with a large amount of print data, ink may adhere to a sheet discharge roller, a guide member, etc. and cause stains such as a rubbing stain and a transfer stain on the recording medium.

Even in the case of single-side printing, stains such as a rubbing stain and a transfer stain may be produced if a recording medium next printed is laid upon a previously printed recording medium before dried in continuous printing. It may take long to finish continuous printing, if printing of the next recording medium is waited until the previously printed recording medium is dried.

It would be desirable that the present invention provides an image forming apparatus that can inhibit stains, such as a rubbing stain and a transfer stain. It would be further desirable that the image forming apparatus achieves reduction of printing time.

It is desirable that an image forming apparatus of the present invention includes a calculating device, a waiting time calculating device, and a print controlling device. The calculating device divides print data to be printed onto a recording medium into a plurality of zones along a conveyance direction of the recording medium. The calculating device calculates printing time and drying time per each divided zone based on a data amount in each zone. The waiting time calculating device calculates waiting time from completion of printing onto the recording medium until the recording medium has been dried, based on the printing time and the drying time per each zone in consideration of elapse of the drying time of the previously printed zone(s) during printing. The print controlling device configures settings for printing of the recording medium based on the waiting time and performs printing according to the settings.

According to the image forming apparatus of the present invention, the waiting time is calculated from completion of printing of a recording medium until the recording medium has been dried, based on the printing time and the drying time per each zone into which the print data is divided along the conveying direction of the recording medium in consideration of elapse of the drying time of the previously printed zone(s) during printing. Printing onto the recording medium is performed based on the waiting time. Thereby, it is possible to reduce time until the recording medium has been dried. Stains such as a rubbing stain and a transfer stain on the recording medium can be inhibited even in continuous printing.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

Figure 1:
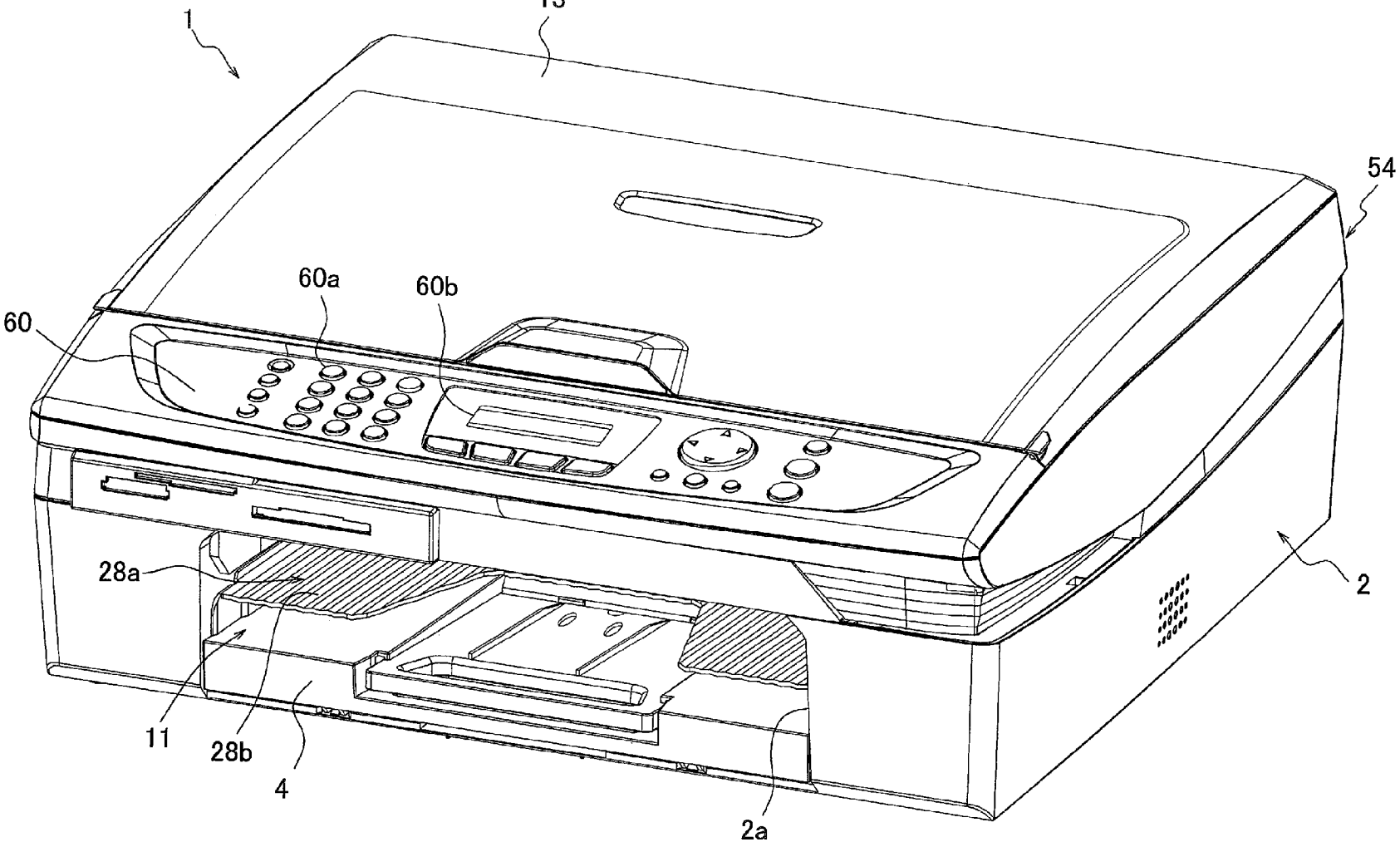
FIG. 1 is a perspective view of an image forming apparatus provided with an inkjet type recording head according to the present invention.
Figure 2:
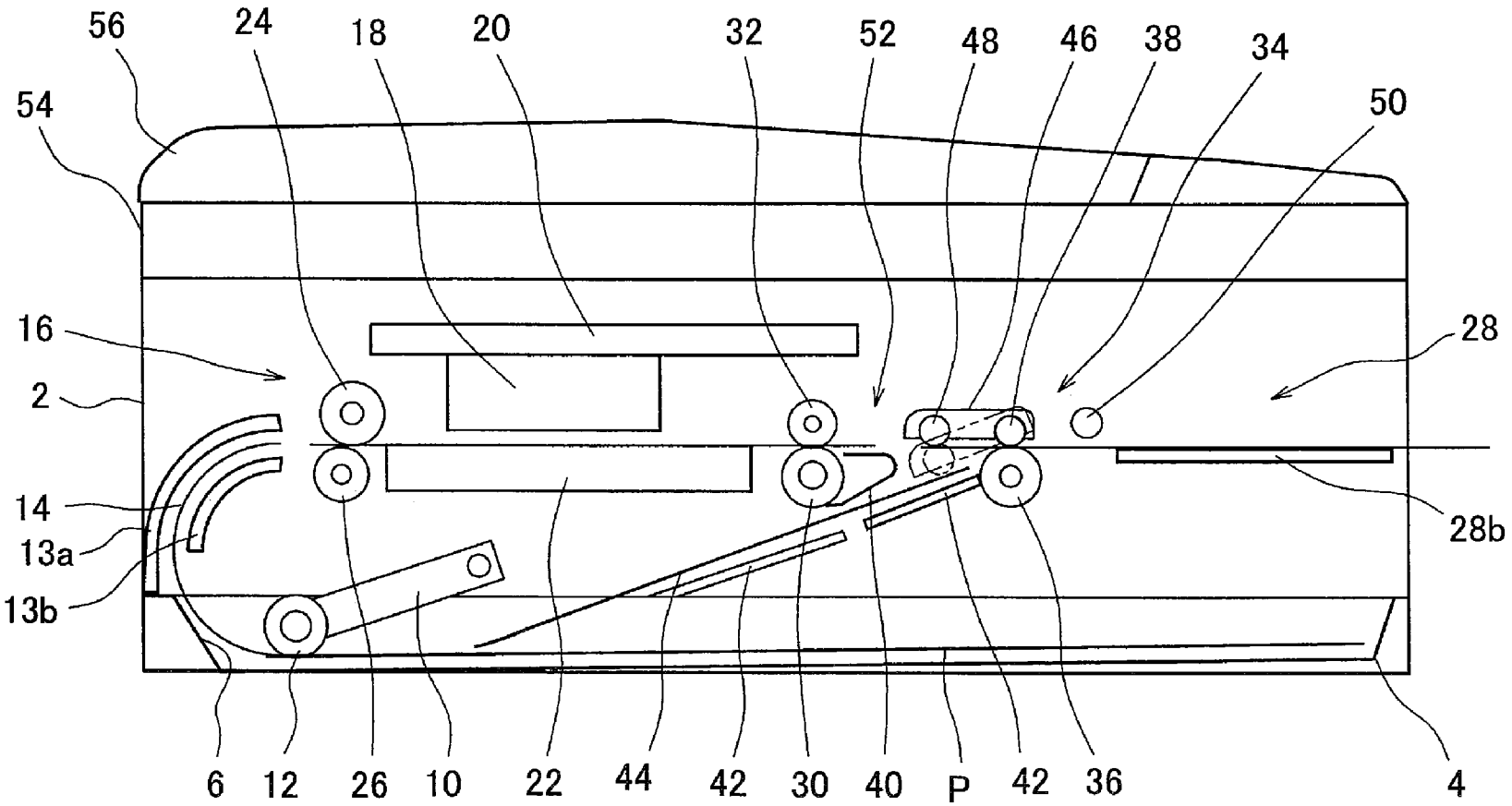
FIG. 2 is an explanatory view showing a schematic constitution of an image forming apparatus of an embodiment.

An image forming apparatus 1 of the present embodiment is a multi function device (MFD) provided with a printer function, a copying function, a scanner function, and a facsimile function. As shown in FIGS. 1 and 2, a sheet feeder portion 11 for feeding of a recording sheet P is provided at the bottom of a housing 2 which is an injection molding made of synthetic resin. The housing 2 constitutes a main body of the image forming apparatus 1. A sheet cassette 4 that accommodates a plurality of recording sheets P in the stack is provided in the sheet feeder portion 11. The sheet cassette 4 can be attached to and detached from the housing 2 through an opening 2*a* formed on the front side of the housing 2.

In the present embodiment, the sheet cassette 4 is capable of accommodating a plurality of recording sheets P of A4 size, letter size, legal size, postcard size, etc. in the stack such that the narrow side (width) of each recording sheet P extends in a direction (main scanning direction) orthogonal to a conveying direction (sub-scanning direction) of the recording sheet P.

As shown in FIG. 2, a tilted separation plate 6 for sheet separation is arranged in the back of the sheet cassette 4. An anchor portion of a feed arm 10 is attached to a not shown frame in such a manner as to rotate in up and down directions. A sheet feed roller 12 driven and rotated by a not shown conveyance motor is provided at a lower end of the feed arm 10. The sheet feed roller 12 and the tilted separation plate 6 separate and convey a recording sheet P stacked in the sheet cassette 4 one by one.

The separated recording sheet P is conveyed to a printing mechanism 16 provided above the sheet cassette 4 through a U-shaped conveyance path 14 formed between a curved first conveyance path wall 13*a* and a curved second conveyance path wall 13*b*.

The printing mechanism 16 is provided with an inkjet type recording head 18 that ejects ink droplets from the downside to print an image onto the recording sheet P, and a carriage 20 that is mounted with the recording head 18 and reciprocates in the main scanning direction. A flat platen 22 is provided below the recording head 18. The platen 22 supports a recording sheet P from beneath so that the recording sheet P faces the recording head 18.

A driving roller 24 and a nip roller 26 which faces the driving roller 24 from beneath are disposed upstream of the platen 22 in the conveying direction. The driving roller 24 and the nip roller 26 are a pair of resist rollers for conveying the recording sheet P onto the upper surface of the platen 22.

A sheet discharge roller 30 and a spur roller 32 are disposed downstream of the platen 22 in the conveying direction. The sheet discharge roller 30 is driven so as to convey the recording sheet P through the printing mechanism 16 to a sheet discharge portion 28 in the conveying direction. The spur roller 32 is opposed and biased to the sheet discharge roller 30.

The sheet discharge portion 28 discharges the recording sheet P on which an image is printed by the printing mechanism 16 with a printed face up. The sheet discharge portion 28 is disposed above the sheet feeder portion 11. A sheet discharge opening 28*a*, which is identical to the opening 2*a*, opens toward the front side of the housing 2. The recording sheet P discharged from the sheet discharge portion 28 is accumulated and stored in a sheet discharge tray 28*b* disposed inside of the opening 2*a*.

A conveyance path 14 provided between the sheet discharge roller 30 and the sheet discharge portion 28 includes a path switching mechanism 34. The path switching mechanism 34 includes a first roller 36 driven by a not shown conveyance motor and a second roller 38 biased to be pressed against the first roller 36. The first roller 36 is disposed below the conveyance path 14.

A first guide wall 40 and a second guide wall 42 are provided between the sheet discharge roller 30 and the first roller 36. A reverse path 44 is formed between the first guide wall 40 and the second guide wall 42.

The second roller 38 is rotatably supported by a switching member 46. The switching member 46 is rotatably supported to a not shown frame. The switching member 46 extends on the side of the spur roller 32. A supplementary roller 48 is rotatably supported on the front end side of the switching member 46. A rotatably supported guide roller 50 is disposed on the side closer to the sheet discharge portion 28 than the second roller 38.

In the present embodiment, the sheet feed roller 12, the driving roller 24, the nip roller 26, the sheet discharge roller 30, the spur roller 32, the conveyance motor (not shown), and the path switching mechanism 34 constitute a conveying mechanism 52. In the conveying mechanism 52, a recording sheet P is conveyed to the side of the sheet discharge portion 28 by the sheet discharge roller 30 and the spur roller 32. Then, the recording sheet P is held between the first roller 36 and the second roller 38 to be discharged onto the sheet discharge tray 28*b*.

At this instant, rotation of the first roller 36 is stopped in a state that a rear end of the recording sheet P is in contact with the supplementary roller 48. The switching member 46 is then rotated as shown in FIG. 2 by a dotted line. Thereby, the rear end of the recording sheet P is pushed down on the side of the reverse path 44. When the first roller 36 is rotated backward at this state, the recording sheet P is conveyed along the reverse path 44 onto other recording sheets P on the sheet cassette 4. The recording sheet P is further conveyed to the conveyance path 14 by the sheet feed roller 12. In this manner, printing can be performed on both sides of the recording sheet P.

An image reading portion 54 is disposed on top of the housing 2. The image reading portion 54 is used for document reading in the copying function and the facsimile function. A rear end of a cover 56 that covers the upper surface of the image reading portion 54 is rotatably attached to a rear end of the image reading portion 54. As shown in FIG. 1, an operation panel 60 provided with various operation buttons 60*a* and a LCD 60*b* is provided in front of the image reading portion 54.

Figure 3:
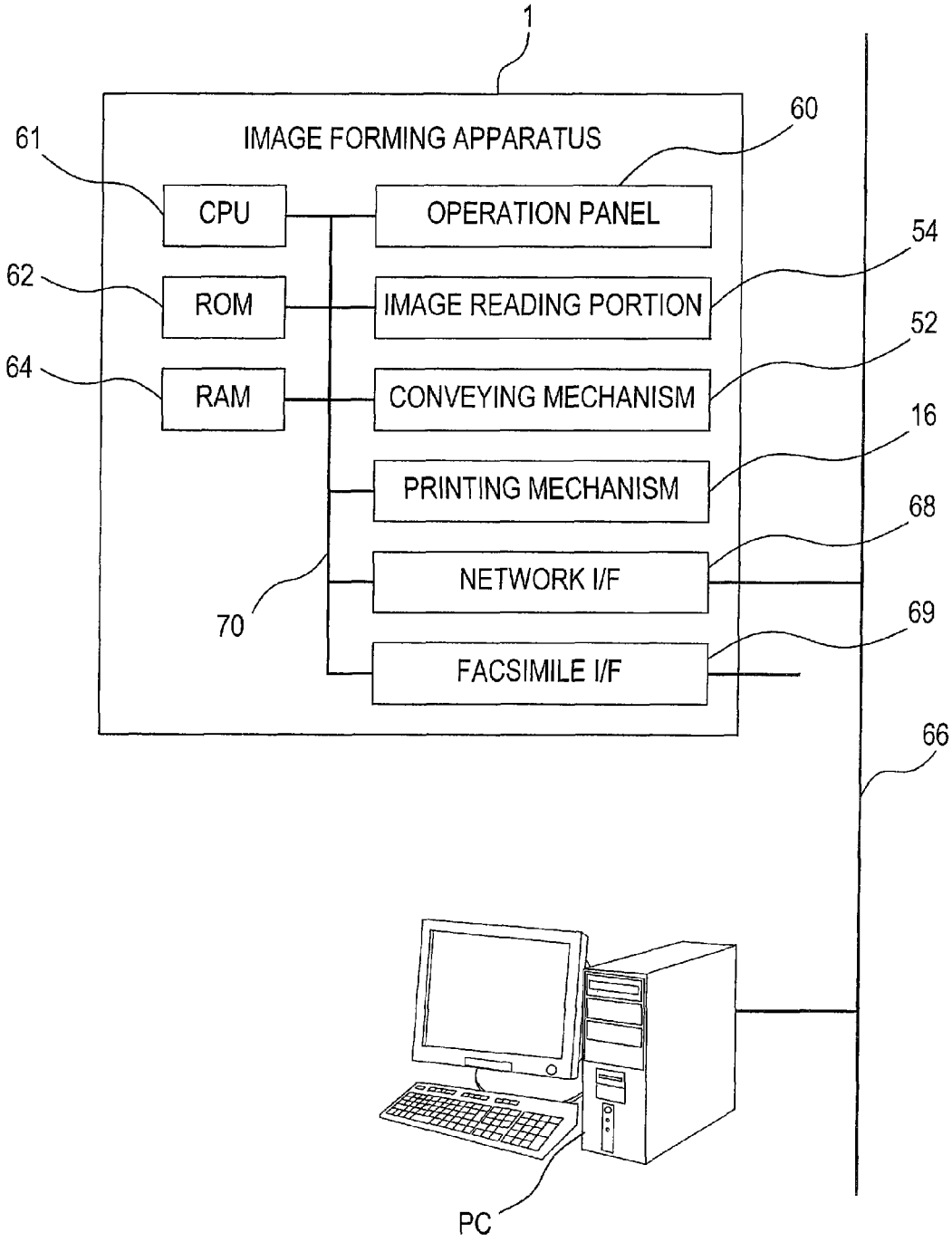
FIG. 3 is a block diagram showing an electric constitution of the image forming apparatus of the embodiment.

As shown in FIG. 3, the image forming apparatus 1 includes a CPU 61, a ROM 62, a RAM 64, and the operation panel 60, the image reading portion 54, the conveying mechanism 52, the printing mechanism 16, a network interface 68, and a facsimile interface 69. These components are connected to each other via a bus 70 for data exchange. The CPU 61 executes processing programs. The ROM 62 stores the processing programs and others. The RAM 64 temporarily stores results of processing, etc. The network interface 68 is used for connection to an external apparatus PC, such as a personal computer, via a network 66 like a LAN.

In the image forming apparatus 1, the CPU 61 expands print data supplied via the network interface 68 from the external apparatus PC to a frame memory within the RAM 64 to form image data. The conveying mechanism 52, the printing mechanism 16, etc. are controlled by the CPU 61 based on the image data expanded to the frame memory within the RAM 64 so that an image is printed onto a recording sheet P. Printing may be color printing or monochrome printing. The printing mechanism 16 may be provided with a recording head of ink ribbon type, other than inkjet type. The printing mechanism 16 may be a laser type with a photoconductive drum, or may be any other type as long as the drying time of ink or toner affects printing onto a next recording sheet P.

Figure 4:
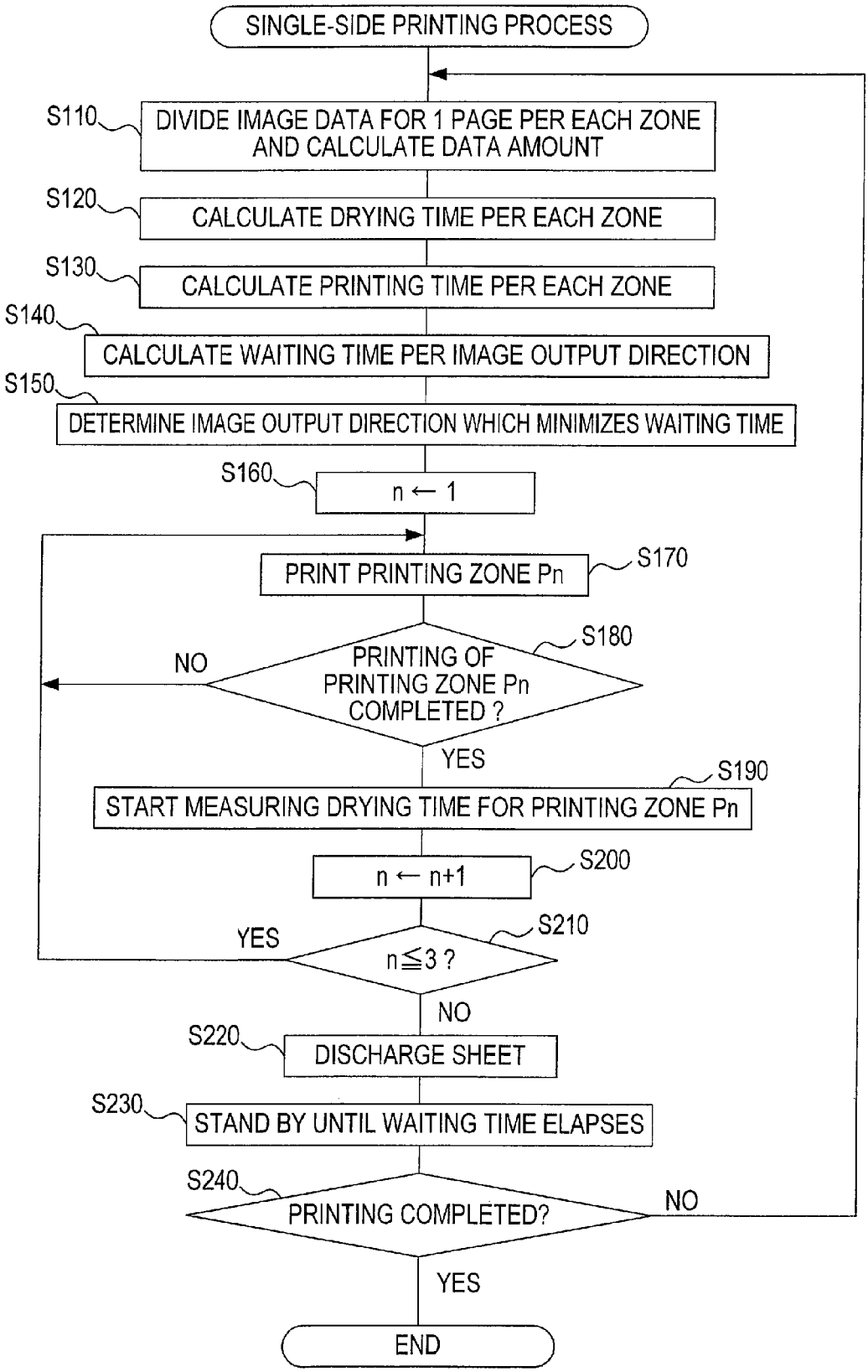
FIG. 4 is a flowchart illustrating a single-side printing process according to the embodiment.

Now, a single-side printing process performed by the image forming apparatus 1 will be explained by way of a flowchart of FIG. 4. Whether to perform single-side printing or duplex printing is set in a driver software preinstalled in the external apparatus PC, for example, at the time of printing.

When print data from the external apparatus PC is supplied via the network interface 68 and when single-side printing is instructed, the print data is expanded to image data as bitmap data to perform the single-side printing process. Firstly, image data for one page to be printed onto a single side of a recording sheet P is divided into each zone (S110).

Figure 5A:
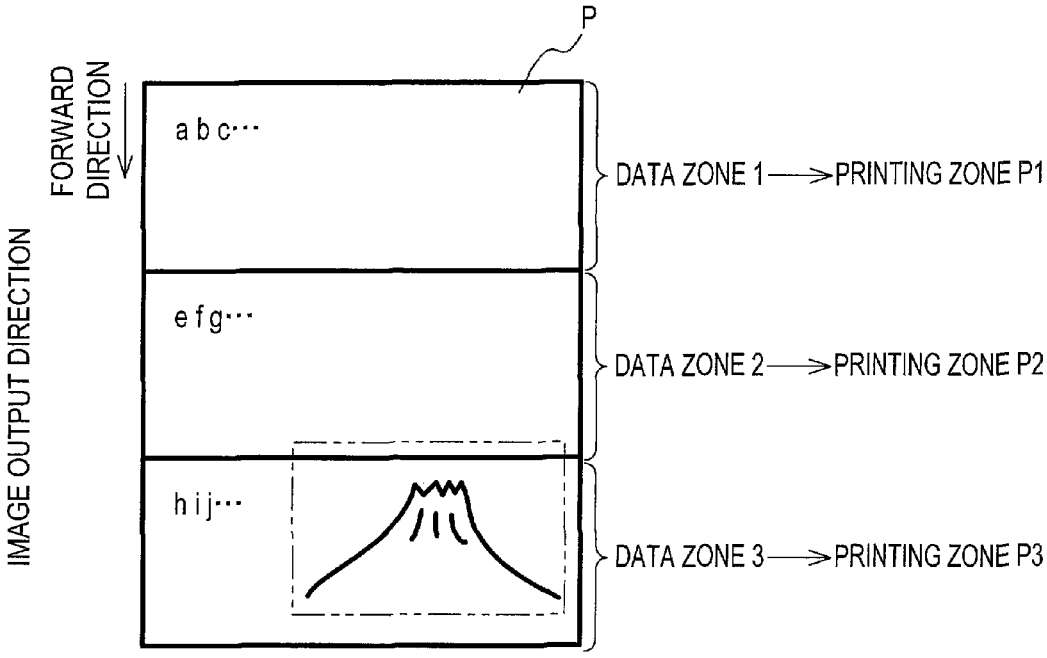
FIGS. 5A and 5B are explanatory views showing print data to be printed on a vertically long recording sheet of the embodiment, the print data being divided along a conveying direction of the recording sheet.
Figure 5B:
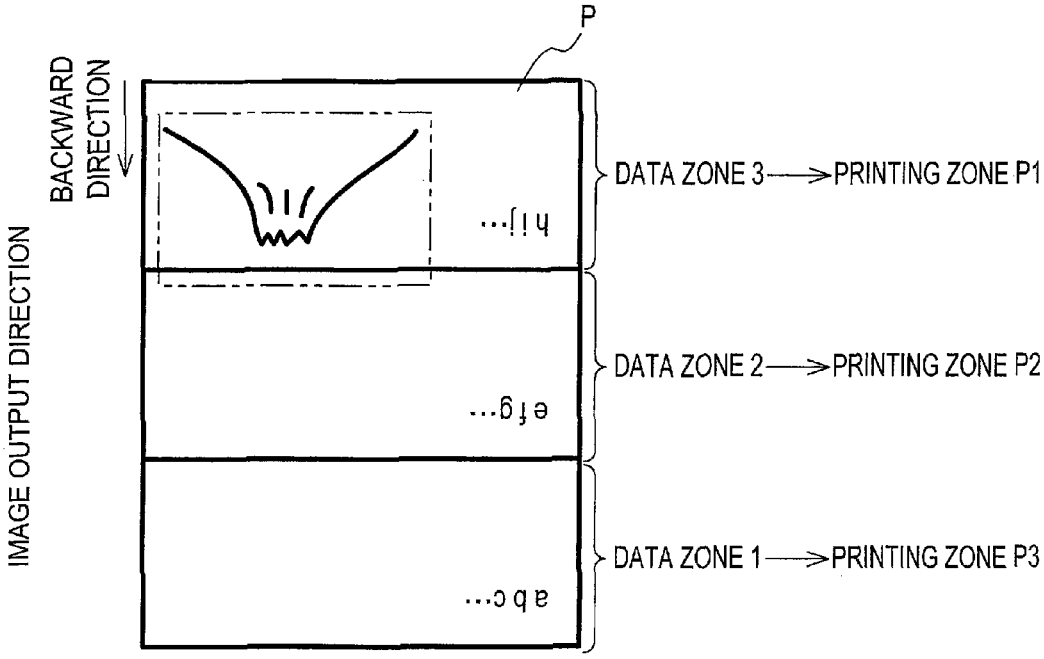

FIGS. 5A and 5B are explanatory views in which image data to be printed onto a vertically long recording sheet P of the present embodiment is divided along the conveying direction of the recording sheet P. An image is printed onto the recording sheet P with the recording head 18 reciprocating in a main scanning direction and the recording sheet P being conveyed in the conveying direction orthogonal to the main scanning direction. As shown in FIG. 5A, division is performed in parallel to the main scanning direction. The recording sheet P is divided into a plurality of zones (three zones in the present embodiment) along the conveying direction of the recording sheet P. The number of divided zones may be two, four or above. The larger the number of divided zones is, the higher calculation accuracy can be obtained of later-explained waiting time.

When printing an image onto the recording sheet P, if printing is started from the head of the image data as shown in FIG. 5A, then the image output direction is called forward, and if the printing is started from the tail of the image data as shown in FIG. 5B, then the image output direction is called backward. In this manner, printing results are normal in the image forming apparatus 1 even if printing is performed in the image output direction of either forward or backward. There is a degree of freedom of two-directional printing.

Figure 6A:
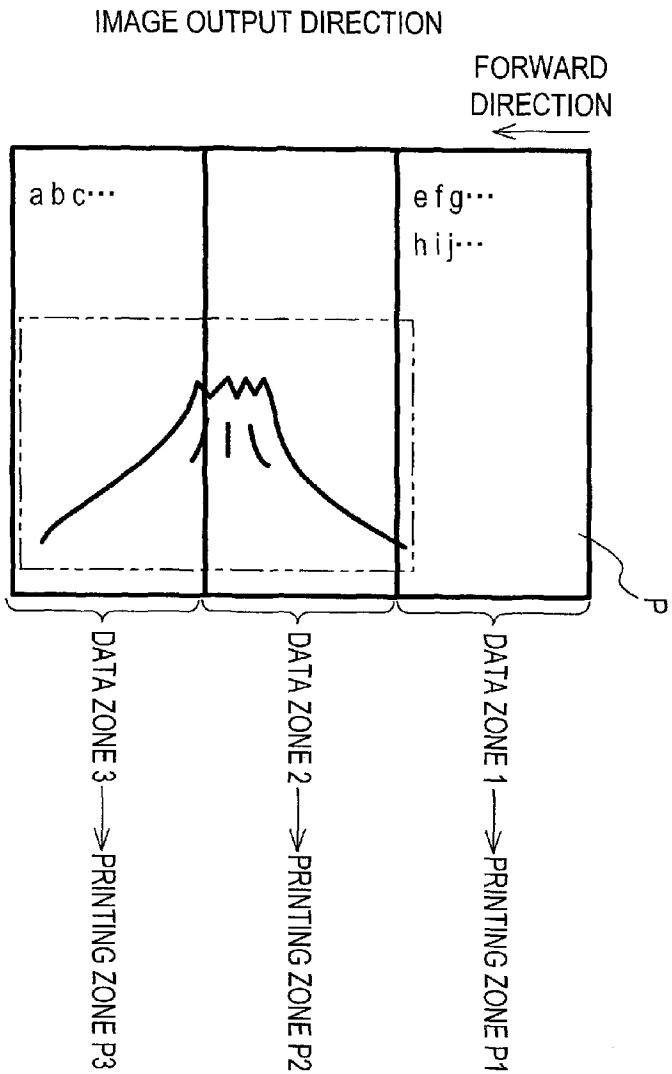
FIGS. 6A and 6B are explanatory views showing print data to be printed on a horizontally long recording sheet of the embodiment, the print data being divided along a conveying direction of the recording sheet.
Figure 6B:
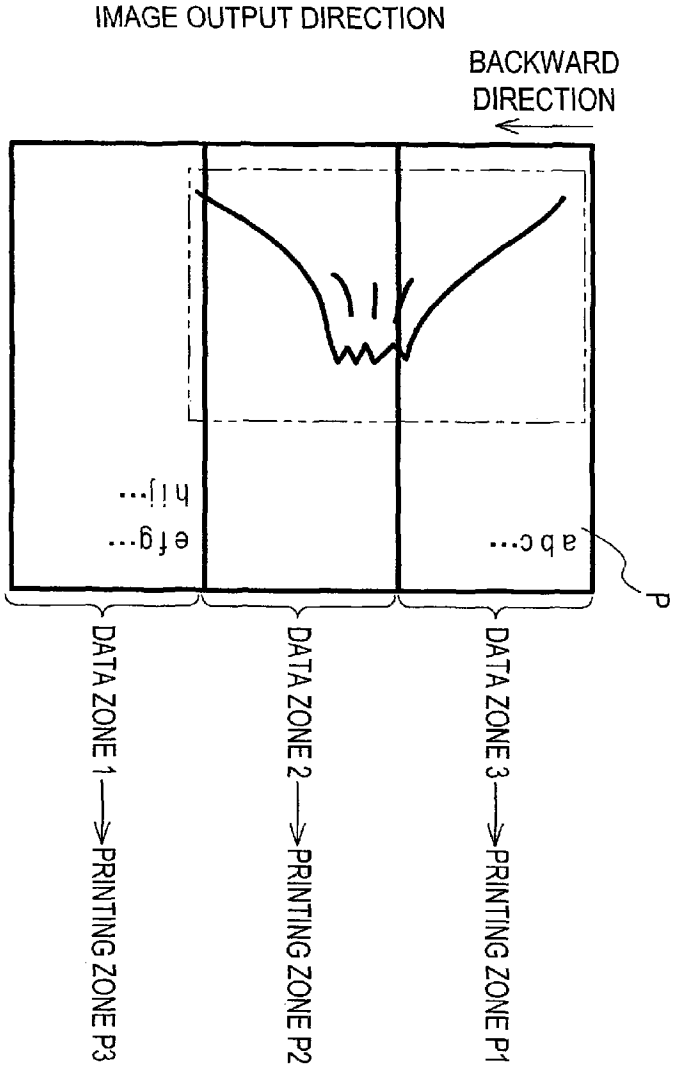

FIGS. 6A and 6B are explanatory views in which image data to be printed onto a horizontally long recording sheet P of the present embodiment is divided along the conveying direction of the recording sheet P. Even if printing is performed by conveying a recording sheet P of A4 size in a longitudinal direction, the recording sheet P may not be used vertically as shown in FIGS. 5A and 5B but may be used horizontally as shown in FIGS. 6A and 6B.

In this case, as shown in FIG. 6A, if the printing is started such that the upside of an image is oriented toward the left side of the recording sheet P, then the image output direction is called forward. As shown in FIG. 6B, if the printing is started such that the upside of an image is oriented toward the right side of the recording sheet P, then the image output direction is called backward. In this manner, printing results are normal in the image forming apparatus 1 even if printing is performed in either the forward or backward direction. There is a degree of freedom of two-directional printing.

In the present embodiment, a data zone where printing in the forward direction is performed first is called "data zone 1", and a data zone where printing in the forward direction is performed last is called "data zone 3".

As shown in FIGS. 5A and 6A, one side of a recording sheet P is equally divided into three data zones in the present embodiment. A data amount contained in each data zone is calculated from the image data. Based on the data amount of each data zone, the drying time per each zone is calculated (S120).

Figure 7:
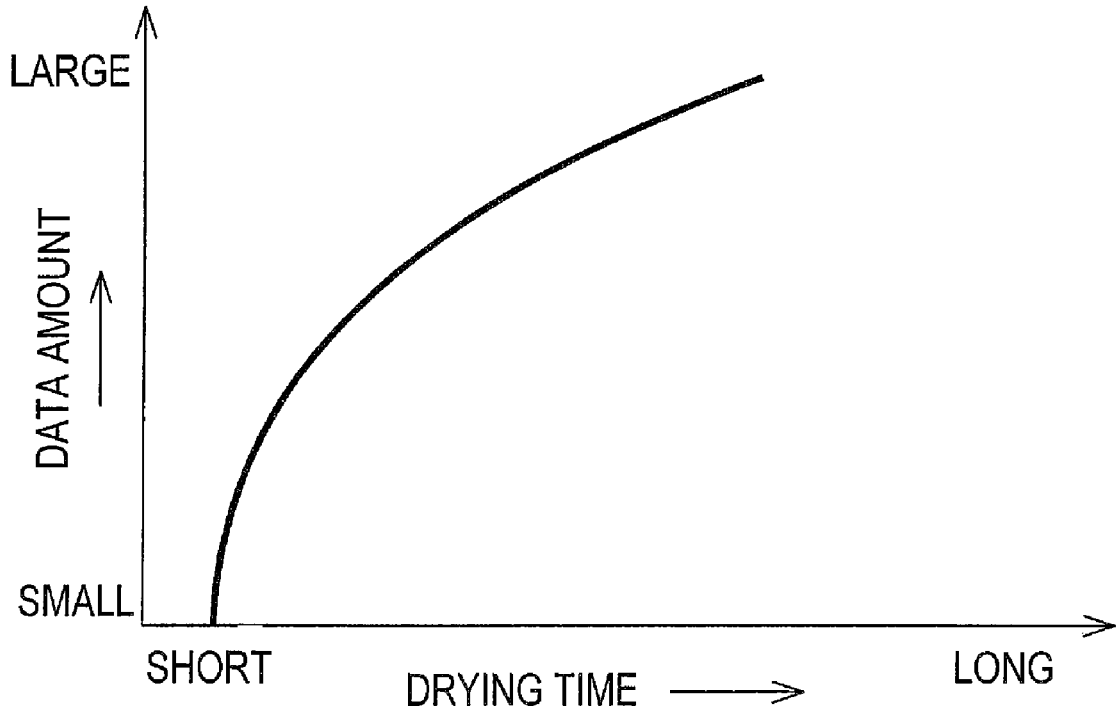
FIG. 7 is a graph showing a relation between a data amount and drying time according to the embodiment.

The data amount corresponds to an amount of ink droplets ejected from the recording head 18. A large amount of data requires a large amount of ink droplets, and long time for drying ink. A relation between the data amount and the drying time is predetermined by experiments, etc. and prestored in the ROM 62, as shown in FIG. 7. The drying time also differs depending on types of the recording sheet P, e.g., plain paper or gloss paper. Thus, it is preferable that the relation between the data amount and the drying time is determined per type of the recording sheet P.

After the drying time per each data zone is calculated, the printing time per each data zone is calculated (S130). Calculation of the printing time is based on the data amount of each data zone in the same manner as in the calculation of the drying time. If there are modes for printing such as a standard mode and a fine mode, the printing time may be calculated in accordance with the specified mode.

After the drying time and the printing time are calculated per each data zone, the waiting time is calculated per image output direction (S140). The image output direction is the aforementioned forward or backward direction when printing is performed onto the recording sheet P. The waiting time for each image output direction is calculated.

For example, if printing is performed in the forward direction, printing of the data zone 1 is firstly performed, and printing of the data zone 2 is subsequently performed, as shown in FIG. 5A. While printing of the data zone 2 is performed, drying of ink makes progress in the previously printed data zone 1. In a similar fashion, while printing of the data zone 3 is performed, drying of ink makes progress in the previously printed data zone 2. Drying of ink makes further progress in the previously printed data zone 1.

The waiting time is time from completion of printing of the data zone 3 until the printing is dried. The waiting time is calculated based on the drying time and the printing time for each data zone of 1 to 3. The waiting time in the forward direction is the largest of: time obtained by subtracting each printing time of the data zones 2 and 3 from the drying time of the data zone 1; time obtained by subtracting the printing time of the data zone 3 from the drying time of the data zone 2; and the drying time of the data zone 3. If subtraction of the printing time from the drying time results in a minus figure, the resulted figure may be regarded as zero.

If printing is performed in the backward direction, the waiting time is the largest of: time obtained by subtracting each printing time of the data zones 2 and 1 from the drying time of the data zone 3; time obtained by subtracting the printing time of the data zone 1 from the drying time of the data zone 2; and the drying time of the data zone 1.

In summary, time is calculated per each divided data zone i ($1<=i<=n-1$) by subtracting a sum of the printing time of all the data zones that are to be printed after the zone i from the drying time of the data zone 1. The waiting time is the largest of all the calculated time and the drying time of the data zone to be printed last.

For example, as shown in FIGS. 5A and 5B, let us assume that the data zone 3 contains photo image data and the data zones 1 and 2 contain much character image data. It is further assumed that the drying time and the printing time of the data zone 1 are 15 seconds and 10 seconds, respectively, the drying time and the printing time of the data zone 2 are 60 seconds and 20 seconds, respectively, and the drying time and the printing time of the data zone 3 are 80 seconds and 25 seconds, respectively.

In the case of printing in the forward direction, the waiting time is 80 seconds since results of the subtraction are 0 ($\leftarrow -30=15-20-25$) seconds, 35 ($=60-25$) seconds, and 80 seconds, respectively.

In the case of printing in the backward direction, the waiting time is 50 seconds since results of the subtraction are 50 ($=80-20-10$) seconds, 50 ($=60-10$), seconds and 15 seconds, respectively.

Settings for printing are configured based on the waiting time. Here, it is determined that the printing is performed in the backward direction which minimizes waiting time (S150). The data zone 3 is set to a printing zone P1, the data zone 2 is set to a printing zone P2, and the data zone 1 is set to a printing zone P3. In the case of forward printing, the data zone 1 is set to the printing zone P1, the data zone 2 is set to the printing zone P2, and the data zone 3 is set to the printing zone P3. The printing zones P1 to P3 correspond to the data zones 1 to 3 sorted in the order of its printing direction.

Subsequently, 1 is substituted for a counter n (S160). Printing of the first printing zone P1 (data zone 3 in the case of printing in the backward direction) is started (S170). It is then determined whether printing of the printing zone P1 is completed (S180). If not (S180: NO), the printing of the printing zone P1 is continued (S170). If the printing is completed (S180: YES), measurement of the drying time of the printing zone P1 (data zone 3) is started (S190).

The counter n is incremented (S200). It is then determined whether the counter n is equal to 3 or less (S210). If the counter n is equal to 3 or less (S210: YES), the steps from S170 onwards are repeated. Printing of the printing zone P2 (data zone 2 in the case of printing in the backward direction) is started (S170). If the printing of the printing zone P2 is completed (S180: YES), measurement of the drying time of the printing zone P2 (data zone 2) is started (S190).

The counter n is incremented (S200). Printing of the printing zone 3 (data zone 1 in the case of printing in the backward direction) is started (S170). If printing of the printing zone P3 is completed (S180: YES), measurement of the drying time of the printing zone P3 (data zone 1) is started (S190).

Again, the counter n is incremented (S200). Since the counter n is equal to 4, it is determined that the counter n is not equal to 3 or less (S210: NO). Since the printing of all the printing zones P1 to P3 is completed, the recording sheet P is discharged onto the sheet discharge tray 28*b* (S220).

Thereafter, the process stands by until the waiting time calculated by the step of S140 elapses (S230). When the waiting time has passed, it is determined whether printing is completed (S240). In the present embodiment, it is determined that the waiting time has passed if the drying time for each of the printing zones P1 to P3 has passed. It should be noted that the elapse of the waiting time may be measured from the end of printing of the printing zone P3 without measuring the elapse of each drying time.

After the waiting time has passed, an indication that the drying time has passed may be given by displaying a message on the LCD 60*b*, so as to notify a user that the printing of the recording sheet P is dried. If there is a next page to print or multiple copies are desired, the steps from S110 onwards are repeated to perform printing onto a next recording sheet P. If it is determined that the printing is completed (S240: YES), the present single-side printing process is ended.

In case that the single-side printing is continued, it is only necessary that the next recording sheet P is not laid upon the previously printed recording sheet P on the sheet discharge tray 28*b* before the elapse of the waiting time. Thus, printing of the next recording sheet P may be started early in consideration of the printing time, so that the waiting time may pass by the time the next recording sheet P is discharged.

In this manner, the image output direction is determined so that the waiting time is minimized. Since the time until printing is dried can be shortened, the total printing time can be reduced. Furthermore, the next recording sheet P is inhibited from being laid upon the previously printed recording sheet P before dried. Thus, stains such as a rubbing stain and a transfer stain can be avoided.

For example, the drying time may be calculated from the data amount of a whole page without dividing the recording sheet P into a plurality of zones. Elapse of the drying time for the whole page may be measured after the printing is completed. However, the total printing time can be shortened if the recording sheet P is divided into a plurality of zones and the waiting time is calculated in consideration of the elapse of the drying time for the previously printed data zone(s). The printing time can be shortened even if printing is started from either the forward or backward direction without determining the image output direction. The printing time can be further reduced if the image output direction is determined so as to minimize the waiting time.

Figure 8:
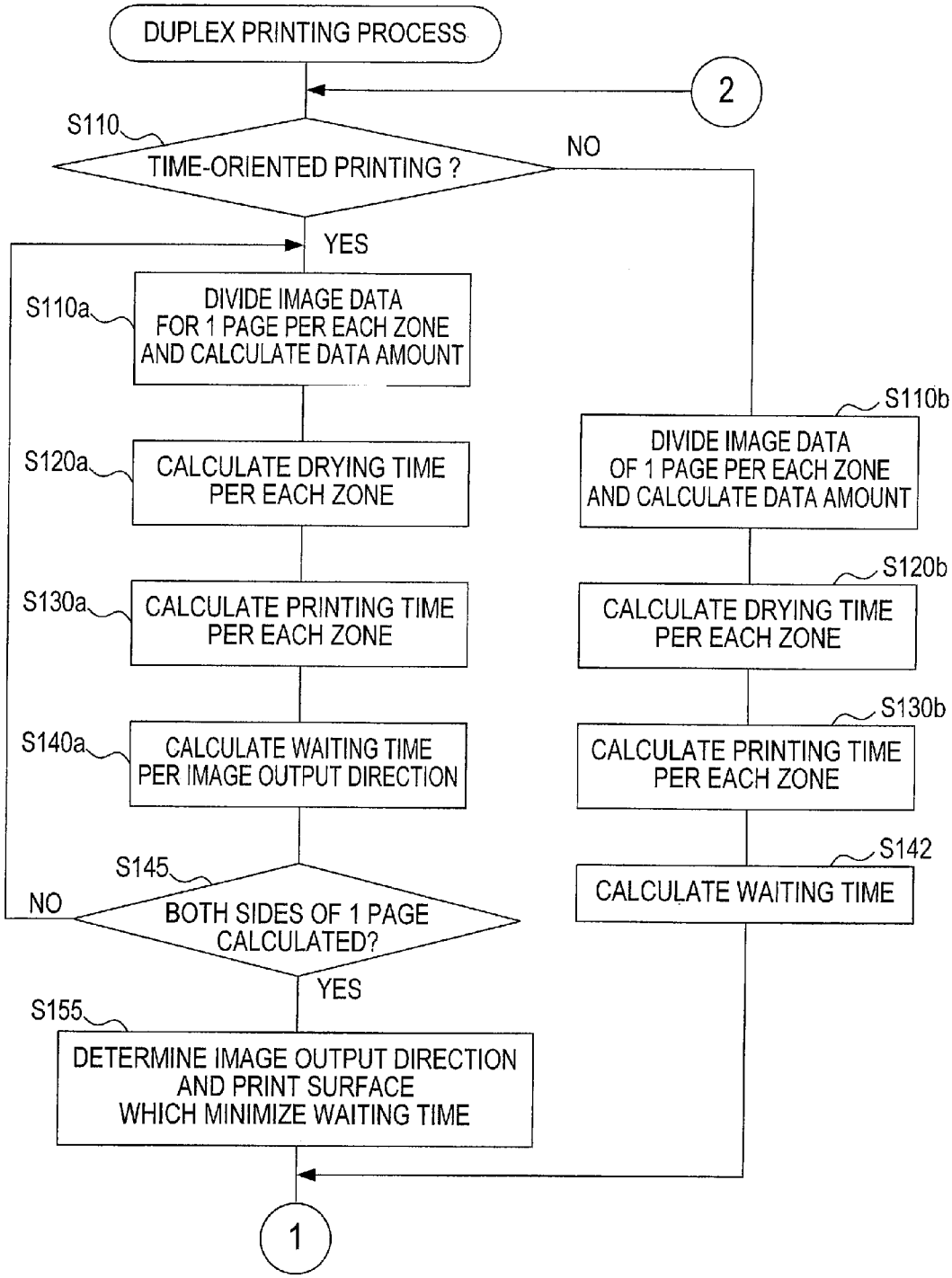
FIG. 8 is a flowchart showing a first half of a duplex printing process according to the embodiment.
Figure 9:
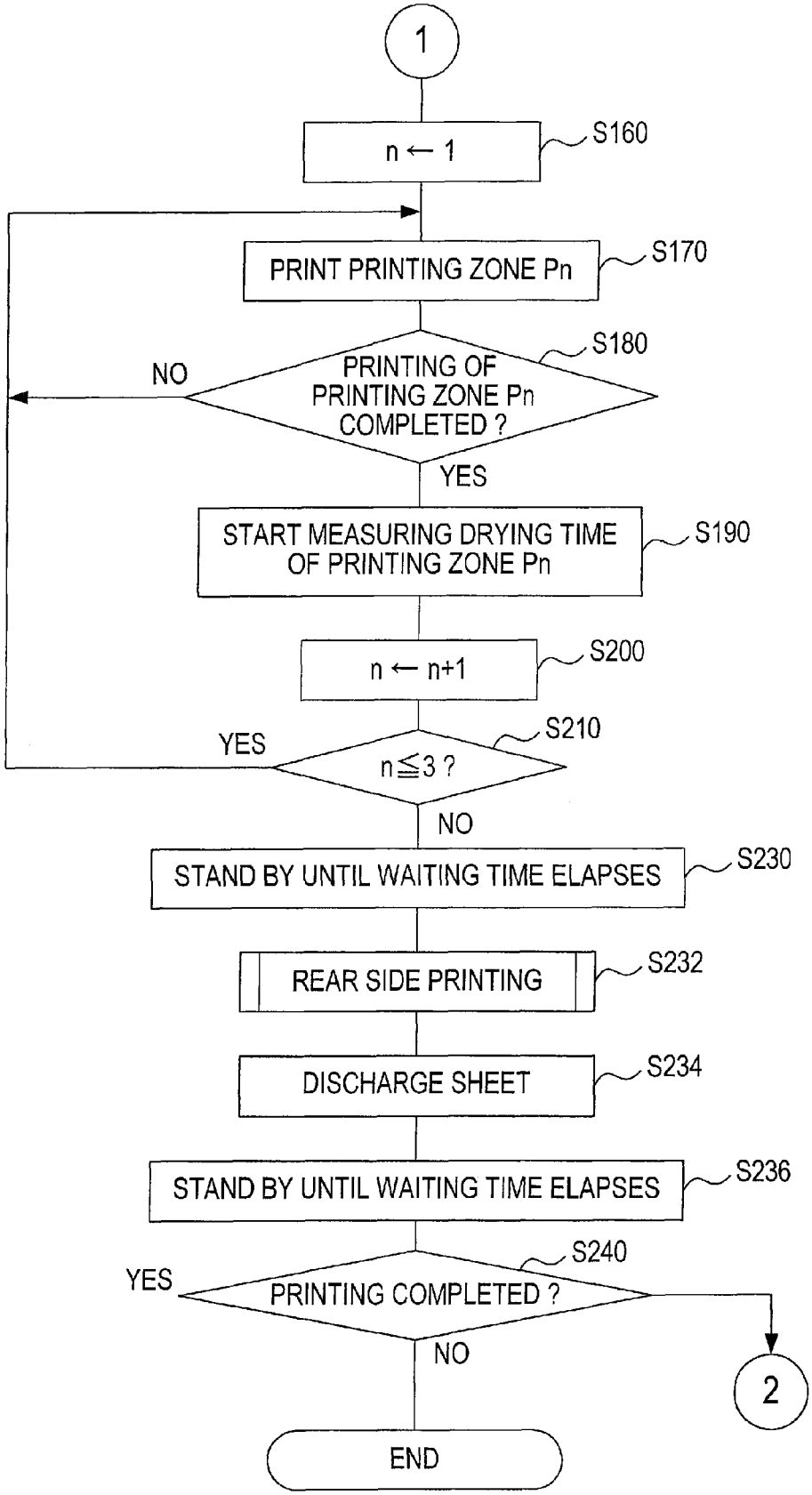
FIG. 9 is a flowchart showing a second half of the duplex printing process according to the embodiment.

Now, a duplex printing process performed in the image forming apparatus 1 will be explained by way of flowcharts of FIGS. 8 and 9. FIG. 8 shows a first half of the duplex printing process of the present embodiment. FIG. 9 is a flowchart showing a second half of the duplex printing process of the present embodiment. The same step number as in the aforementioned single-side printing process or the same step number with an alphabetical subscript will be added to the identical step in the duplex printing process. The detailed description of the identical step is not repeated.

When the print data from the external apparatus PC is supplied via the network interface 68 and when duplex printing is instructed, the print data is expanded to image data as bitmap data to perform the duplex printing process.

Firstly, it is determined whether time-oriented printing is instructed (S100). Whether or not to instruct time-oriented printing is set by execution of the driver software. The time-oriented printing attempts reduction of printing time. If the time-oriented printing is instructed (S100: YES), image data for one page is divided into three data zones 1 to 3 to calculate the data amount in each zone (S110*a*).

Subsequently, the drying time for each data zone of 1 to 3 is calculated (S120*a*). The printing time of each data zone of 1 to 3 is also calculated (S130*a*). Thereafter, the waiting time per image output direction, that is, the forward and backward directions, on one side is calculated (S140*a*).

It is then determined whether the waiting time for both sides of the one recording sheet P is calculated (S145). If not (S145: NO), the steps from S110*a* onwards are repeated to calculate the printing time, the drying time, and the waiting time for the other side of the recording sheet P (S110*a* to S140*a*).

When it is determined that the printing time, the drying time, and the waiting time have been calculated for both sides of the recording sheet P (S145: YES), the image output direction and a print surface which goes through printing first are determined to minimize the waiting time (S155).

Assuming that image data A is to be printed on the first page (the front side of the recording paper P) and image data B is to be printed on the second page (the rear side of the recording paper P) upon duplex printing, the image output direction of the image data A is opposite to the image output direction of the image data B in the present embodiment, because of the structure of the path switching mechanism 34. FIGS. 10A to 10D are explanatory views of the image output directions at duplex printing according to the present embodiment.

Figure 10A:
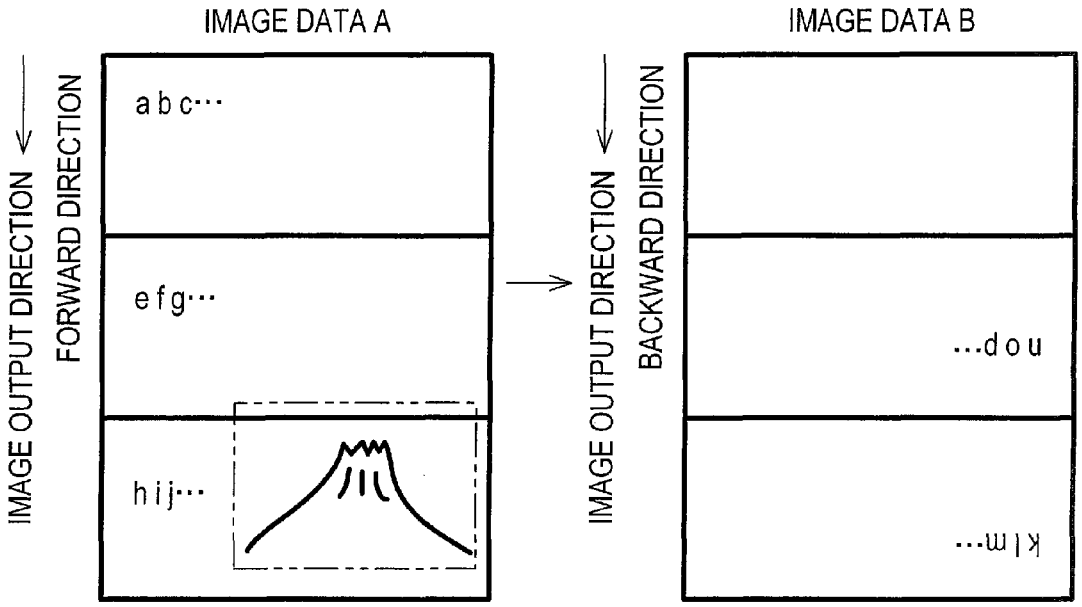
FIGS. 10A to 10D are explanatory views for image output directions at duplex printing.
Figure 10B:
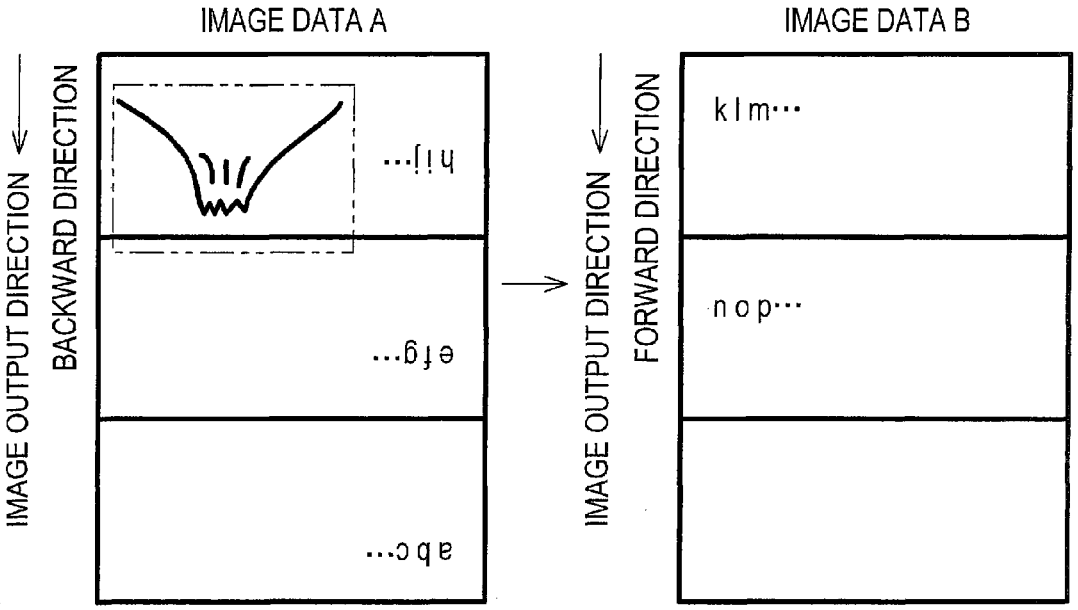

As shown in FIG. 10A, if printing of the image data A is started in the forward direction, printing of the image data B is performed in the backward direction. Also, as shown in FIG. 10B, if printing of the image data A is started in the backward direction, printing of the image data B is performed in the forward direction.

Figure 10C:
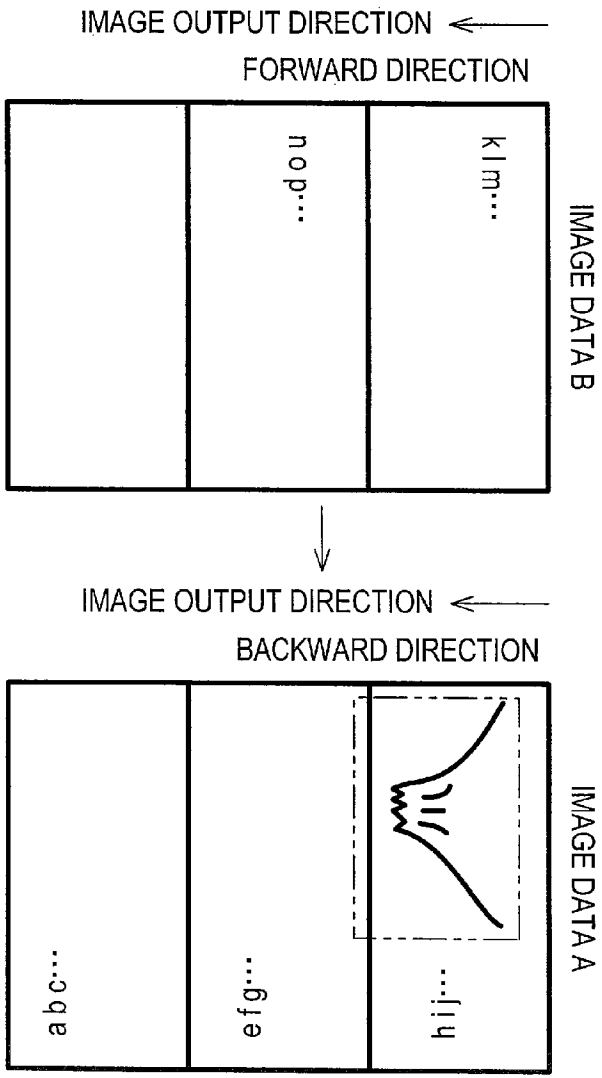
Figure 10D:
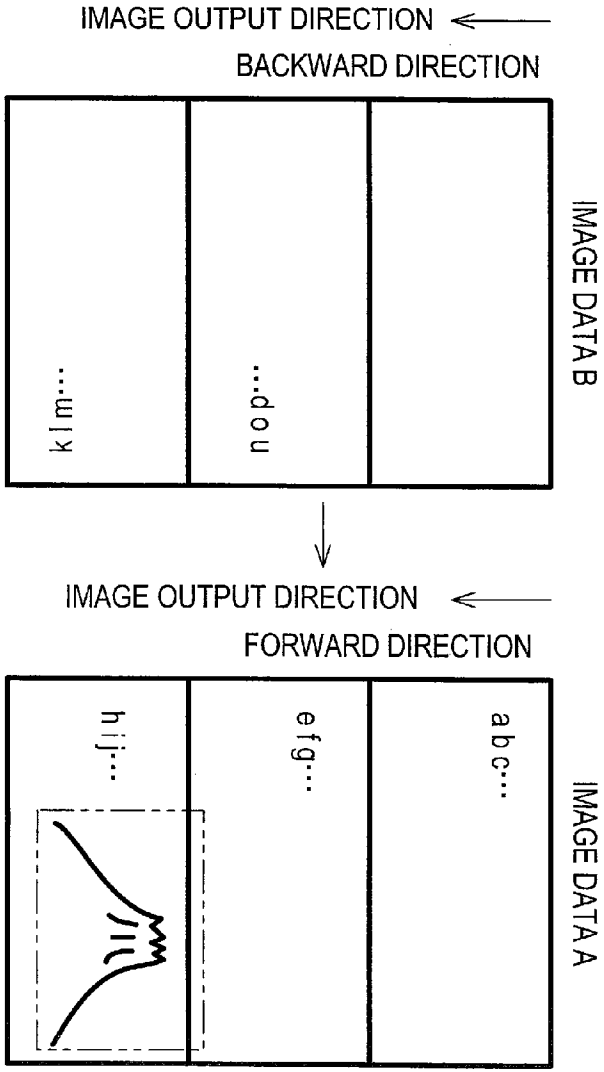

Moreover, as shown in FIG. 10C, if printing of the image data B is started in the forward direction, printing of the image data A is performed in the backward direction. Also, as shown in FIG. 10D, if printing of the image data B is started in the backward direction, printing of the image data A is performed in the forward direction. When printing an image on both sides of the recording sheet P in the image forming apparatus 1, printing results are normal even though printing is performed in either image output direction of forward or backward, and either print surface (on which either of the image data A or B to be printed) goes through printing first. The image forming apparatus 1 has a degree of freedom of four-directional printing.

As a result of execution of the steps from S110*a* to S145, the waiting time for each of the four directions in FIGS. 10A to 10D is calculated. Thus, the image output direction of either forward or backward and the print surface on which either the image data A or the image data B is firstly printed are determined to minimize the waiting time.

Thereafter, 1 is substituted for the counter n (S160). Printing of the printing zone P1 is started (S170). For example, if the waiting time is minimized when printing of the image data A is started in the backward direction as shown in FIG. 10B, the data zone 3 of the image data A is regarded as the printing zone P1 and printing is started.

It is then determined whether the printing of the printing zone P1 is completed (S180). If completed (S180: YES), measurement of the drying time for the printing zone P1 is started (S190). Then, the counter n is incremented (S200). The steps from S170 to S210 are repeated until the counter n is equal to 3 or above. In this manner, printing of the data zones 1 to 3 of the image data A is performed. At the same time, measurements of the drying time for the printing zones P1 to P3 are respectively performed.

After printing of one side is completed, the process stands by until the waiting time elapses (S230). If all the drying time for the respective printing zones P1 to P3 has passed, it is determined that the waiting time has elapsed. At standby of duplex printing, rotation of the first roller 36 is stopped in a state that the rear end of the recording sheet P is in contact with the supplementary roller 48.

After the waiting time has passed, printing of the image data B on the other side of the recording sheet P is started (S230). At the printing on the other side, the switching member 46 is rotated as shown in FIG. 2 by the dotted line, so that the rear end of the recording sheet P is pushed up on the side of the reverse path 44. In this state, the first roller 36 is rotated in reverse. The recording sheet P is conveyed onto other recording sheets P on the sheet cassette 4 via the reverse path 44, and further conveyed to the conveyance path 14 by the sheet feed roller 12.

The surface on which the image data A has been printed may be brought in contact with the surface of the sheet feed roller 12 at that time. However, since the waiting time has passed and printing is dried, stains like a rubbing stain and a transfer stain are not caused by the contact with the sheet feed roller 12. Likewise, no stain is caused upon conveyance in the conveyance path 14, because printing is dried. Moreover, the printing time is shortened since the image output direction and the print surface are determined to minimize the waiting time.

In the present embodiment, printing of the image data B is performed in the forward direction as shown in FIG. 10B. After the printing of the image data B, the recording sheet P is discharged onto the sheet discharge tray 28*b* (S234). Subsequently, the process stands by until the waiting time, which has been calculated by execution of the steps from S110*a* to S145, elapses from the end of the printing of the image data B until the printing is dried (S236). It is then determined whether printing is ended (S240).

If printing is not completed (S240: NO), the steps from S100 onwards are repeated. When time-oriented printing is performed by repetition of the steps from S100 onwards, the printing time is shortened since the image output direction and the print side on which either of the image data A or the image data B is firstly printed are determined per each recording sheet P to minimize the waiting time.

On the other hand, if it is determined in S100 that time-oriented is not instructed (S100: NO), image data for one page is divided per each data zone of 1 to 3 to calculate each data amount. (S110*b*).

Subsequently, the drying time per each data zone of 1 to 3 is calculated (S120*b*). Also, the printing time of each data zone of 1 to 3 is calculated (S130*b*). Subsequently, the waiting time in the case of printing in the forward (or backward) direction is calculated (S142).

In the same manner as mentioned above, the steps from S160 onwards are executed. An image is printed on the recording sheet P. Thereby, as shown in FIG. 10A, the image data A is printed in the forward direction and the image data B is printed in the backward direction. Printing from the next page onwards is performed in the same manner. Accordingly, a plurality of recording sheets P are printed and accumulated on the sheet discharge tray 28*b* with their orientation and pages in order. There is no need to sort the printed recording sheets P.

In this case as well, the other side of the recording sheet P is printed after the waiting time has passed. Thus, stains such as a rubbing stain and a transfer stain do not occur. The waiting time is also calculated in consideration of the printing time of the previously printed zone(s). Accordingly, the printing time can be shortened.

For example, the drying time may be calculated from the data amount of a whole page without dividing a recording sheet into a plurality of zones. Elapse of the drying time for the whole page may be measured after printing is completed. However, the printing time can be shortened if a recording sheet is divided into a plurality of zones and the waiting time is calculated in consideration of the elapse of the drying time for the previously printed data zone(s). The printing time can be shortened even if printing is performed in a state that the direction and pages are sorted.

In the aforementioned single-side printing process and duplex printing process, execution of the steps S110 to S130, S110*a* to S130*a*, and S110*b* to S130*b* functions as the calculating device. Execution of the steps S140 and S140*a* functions as the waiting time calculating device. Execution of the steps S150 to S210 functions as the print controlling device.

The present invention should not be limited by the above described embodiment. It should be noted that the present invention can be practiced in various manners without departing from the scope of the present invention.

What is claimed is:

1. An image forming apparatus comprising:

a calculating device that divides print data to be printed onto a recording medium into a plurality of zones along a conveyance direction of the recording medium, and, before printing on the recording medium, calculates printing time and drying time per each divided zone based on a data amount in each zone;

a waiting time calculating device that, before printing on the recording medium, calculates waiting time from completion of printing onto the recording medium until the recording medium has been dried, based on the printing time and the drying time per each zone in consideration of elapse of the drying time of the previously printed zone(s) during printing; and a print controlling device that, before printing on the recording medium, configures settings for printing of the recording medium based on the waiting time and performs printing according to the settings; wherein said plurality of zones are n zones, wherein n is an integer larger than 1, before printing on the recording medium, the waiting time calculating device calculates time per each divided zone i by subtracting a sum of the printing time of all the zones that are to be printed after the zone i from the drying time of the zone i, and sets the largest of all the calculated time and the drying time of the zone to be printed last to the waiting time, wherein $1 \leqq i \leqq n-1$.

2. The image forming apparatus according to claim 1, wherein the waiting time is calculated without consideration of the printing time of the zone that is printed the earliest.

3. The image forming apparatus according to claim 1, wherein the waiting time calculating device calculates the waiting time from completion of printing of the print data until the printing is dried per image output direction, based on the printing time and the drying time per each zone in consideration of elapse of the drying time of the previously printed zone(s) during printing, and the print controlling device starts printing onto the recording medium in the image output direction of the print data which minimizes the waiting time.

4. The image forming apparatus according to claim 3, wherein the calculating device calculates the printing time and the drying time per each zone of each side of the recording medium upon duplex printing, the waiting time calculating device calculates the waiting time per image output direction of the print data for each side of the recording medium, the print controlling device starts printing on the side of the recording medium and in the image output direction of the print data which minimize the waiting time.

5. The image forming apparatus according to claim 1, wherein the print controlling device starts measuring elapse of the set waiting time when printing of the zone to be printed last is completed, and stands by until the waiting time elapses.

6. The image forming apparatus according to claim 5, wherein the print controlling device starts printing on the other side of the recording medium when printing of one side of the recording medium is finished and the waiting time has passed.

7. The image forming apparatus according to claim 5, wherein the print controlling device starts printing onto a next recording medium upon elapse of the waiting time when printing multiple copies.

8. The image forming apparatus according to claim 1, wherein the print controlling device starts measuring the drying time of each data zone per each divided zone when printing of each zone is completed, and stands by until elapse of the all the drying time when printing of the zone to be printed last is completed.

9. The image forming apparatus according to claim 8, wherein the print controlling device starts printing on the other side of the recording medium when printing of one side of the recording medium is finished and the waiting time has passed.

10. The image forming apparatus according to claim 8, wherein the print controlling device starts printing onto a next recording medium upon elapse of the waiting time when printing multiple copies.

11. The image forming apparatus according to claim 1, wherein the calculating device calculates the printing time and the drying time for each zone based on a relation between a predetermined data amount and drying time.

* * * * *